US012055360B2

(12) United States Patent
Young et al.

(10) Patent No.: US 12,055,360 B2
(45) Date of Patent: Aug. 6, 2024

(54) MAGAZINE FOR FIREARMS

(71) Applicants: Nicholas E. Young, Murray, UT (US); Cody Lee Rients, South Salt Lake, UT (US); Kyle Hill, Farmington, UT (US)

(72) Inventors: Nicholas E. Young, Murray, UT (US); Cody Lee Rients, South Salt Lake, UT (US); Kyle Hill, Farmington, UT (US)

( * ) Notice: Subject to any disclaimer, the term of this patent is extended or adjusted under 35 U.S.C. 154(b) by 83 days.

(21) Appl. No.: 18/087,698

(22) Filed: Dec. 22, 2022

(65) Prior Publication Data

US 2023/0349653 A1 Nov. 2, 2023

Related U.S. Application Data

(60) Provisional application No. 63/293,030, filed on Dec. 22, 2021.

(51) Int. Cl.
*F41A 9/69* (2006.01)
*F41A 9/68* (2006.01)
*F41A 9/70* (2006.01)

(52) U.S. Cl.
CPC *F41A 9/68* (2013.01); *F41A 9/69* (2013.01); *F41A 9/70* (2013.01)

(58) Field of Classification Search
CPC ..... F41A 9/69; F41A 9/70; F41A 9/68; F41A 17/38
USPC ..... 42/50, 18, 22, 49.01
See application file for complete search history.

(56) References Cited

U.S. PATENT DOCUMENTS

| | | | | |
|---|---|---|---|---|
| 3,345,771 | A | 10/1967 | Silsby | |
| 3,672,089 | A | 6/1972 | Silsby | |
| 4,447,976 | A * | 5/1984 | Cooper | F41A 9/63 42/49.02 |
| D645,112 | S | 9/2011 | Sullivan et al. | |
| D646,742 | S | 10/2011 | Sullivan et al. | |
| 8,061,071 | B2 | 11/2011 | Fitzpatrick et al. | |
| 8,813,406 | B1 | 8/2014 | Sullivan et al. | |
| 8,844,183 | B2 | 9/2014 | Sullivan | |
| 9,651,324 | B2 * | 5/2017 | Hayes | F41A 9/69 |
| 9,797,668 | B2 * | 10/2017 | Hayes | F41A 9/69 |
| 10,866,045 | B2 | 12/2020 | Schumacher et al. | |
| D1,016,207 | S * | 2/2024 | Young | D22/108 |
| 2009/0223103 | A1 * | 9/2009 | Young | F41A 9/70 42/50 |
| 2015/0075050 | A1 * | 3/2015 | Hayes | F41A 9/70 42/50 |
| 2015/0316339 | A1 * | 11/2015 | Young | F41A 35/06 42/49.01 |
| 2015/0345882 | A1 * | 12/2015 | Nakayama | F41A 9/70 42/50 |
| 2017/0248382 | A1 * | 8/2017 | Hayes | F41A 9/69 |
| 2018/0087860 | A1 * | 3/2018 | Sullivan | F41A 3/72 |
| 2018/0299218 | A1 * | 10/2018 | Myers | F41A 9/70 |
| 2019/0162496 | A1 * | 5/2019 | Hogan, Jr. | F41A 9/69 |
| 2020/0225013 | A1 * | 7/2020 | Young | F42B 39/26 |

(Continued)

FOREIGN PATENT DOCUMENTS

| | | |
|---|---|---|
| DE | 102019000388 B4 | 7/2020 |
| DE | 102020000297 A1 | 7/2021 |

*Primary Examiner* — Michael D David

(57) ABSTRACT

A detachable magazine for firearms is provided that includes a magazine body having a quad stack region and a transition region and a follower assembly having a follower body, the follower body configured to travel through both the quad stack region and the transition region.

16 Claims, 10 Drawing Sheets

(56) References Cited

U.S. PATENT DOCUMENTS

2023/0349653 A1* 11/2023 Young ..... F41A 9/68
2023/0392890 A1* 12/2023 Young ..... F41A 9/69

* cited by examiner

MAGAZINE FOR FIREARMS

CROSS-REFERENCE TO RELATED APPLICATION

This application is a non-provisional application of U.S. Provisional 63/293,030 entitled "MAGAZINE FOR FIREARMS" filed Dec. 22, 2021, the disclosure of which is hereby incorporated by reference in its entirety.

BACKGROUND

It may be desirable to increase the capacity of a detachable magazine without increasing the overall length of such a detachable magazine.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

A detachable magazine for firearms is discussed herein that includes a magazine body having a top portion having a feed region formed therein. The magazine body also includes a bottom portion, a left sidewall extending from the top portion to the bottom portion and a right sidewall extending from the top portion to the bottom portion. The right sidewall is spaced apart the left sidewall to define a magazine body recess. The left sidewall and the right sidewall are generally parallel to each other. A central magazine plane is defined between the left sidewall and the right sidewall. The magazine body further includes a transition region in communication with the feed region.

A quad stack region is in communication with the transition region. The detachable magazine further includes a follower assembly having a follower body. The follower body is configured to be received at least partially within the magazine body recess. The follower assembly is configured to travel through both the quad stack region and the transition region and into communication with the feed region.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

As will be discussed in more detail hereinafter, a detachable magazine is provided that is configured to store a high number of cartridges relative to its length while being compatible with standard upper receivers. Such a configuration may reduce reloads and a number of detachable magazines associated with a full load out for operators.

Figure 1A:
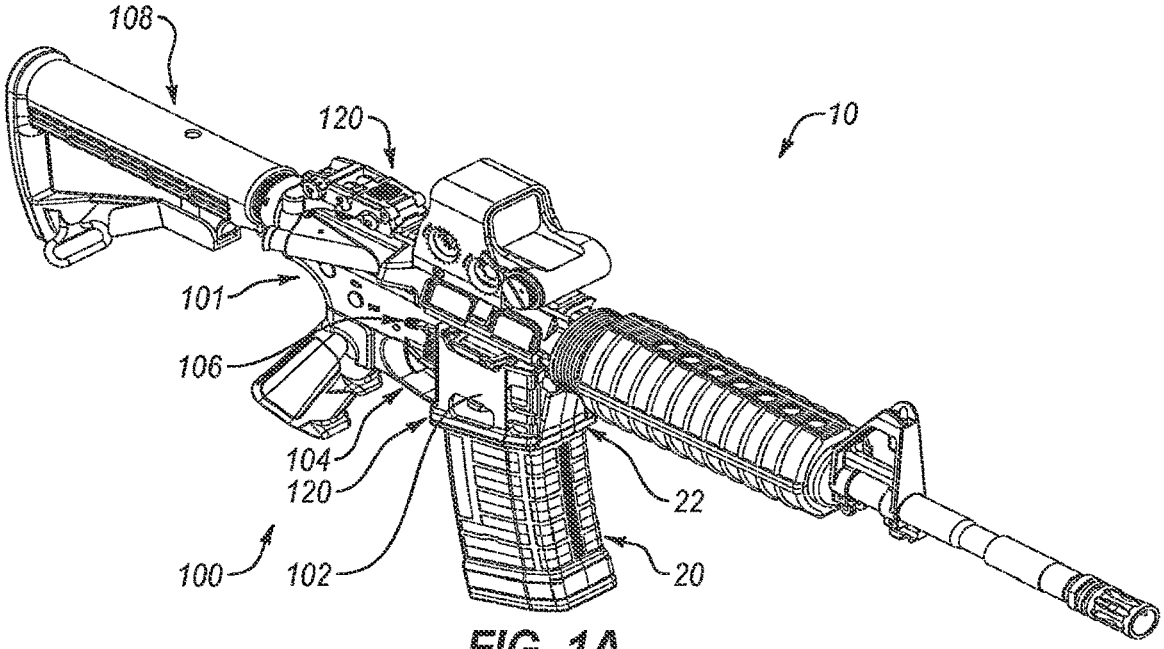
FIG. 1A illustrates a perspective view of a firearm with a detachable magazine coupled thereto.

FIG. 1A is a perspective view of a firearm 10 having a lower receiver assembly 100 and an upper receiver assembly 120. The lower receiver assembly 100 includes a lower receiver 101. The lower receiver 101 is configured to have the upper receiver assembly 120 coupled thereto. In particular, the upper receiver 120 is configured to be compatible with AR-15/M-4/M-16 standard components (hereinafter referred to as "AR-15 compatible"). In such an example, the engagement between the upper receiver 120 and the lower receiver 100 is well known in the art. Further, the lower receiver 100 is configured to have components and sub-assemblies coupled thereto to interact with the upper receiver assembly 120 when the lower receiver 100 is part of the assembled firearm 10.

As shown in FIG. 1A, the lower receiver 100 includes a magazine well 102 configured to have a detachable magazine 20 coupled thereto and to move out of engagement with the magazine well 102. Accordingly, the magazine well 102 may be configured to allow the detachable magazine 20 to couple thereto while still allowing standard coupling with the AR-15 compatible upper receiver assembly 120.

Further, in at least one example, the lower receiver assembly 100 may be configured to make use of additional standard components that are AR-15 compatible. For example, the lower receiver assembly 100 further includes a trigger assembly 104 and a safety assembly 106. In at least one example, the trigger assembly 104 is configured as an AR-15 compatible trigger while the safety assembly 106 is configured as an AR-15 compatible safety assembly as are both well known in the art.

In another example, the lower receiver 101 is configured to have a buffer tube assembly 108 coupled thereto. However, it will be appreciated that other configurations are possible. For example, the lower receiver 101 may be configured to couple with a bufferless pistol or other configuration without affecting the configuration or operation of the magazine well 102.

Figure 1B:
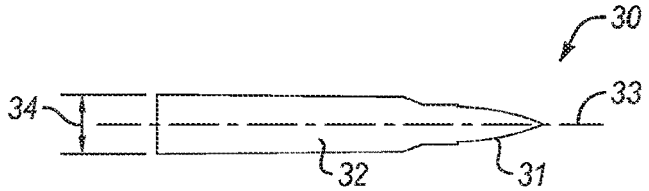
FIG. 1B illustrates an exemplary cartridge configured for use in the detachable magazine.

When assembled as part of the firearm 10, the lower receiver 101 is configured to facilitate the firing of a nominal round 30 (FIG. 1B). For example, AR pattern rifles are often configured to fire .223 or 5.56 rounds.

FIG. 1B illustrates a nominal round 30, which typically has a projectile 31 and a case 32 containing power (not shown) and a primer (not shown). The nominal round 30 generally has a central axis 33. A width 34 of the nominal round 30 is defined as the dimension of the widest portion of a nominal round 30 as measured perpendicular to the central axis 33 of the nominal round 30.

Figure 1C:
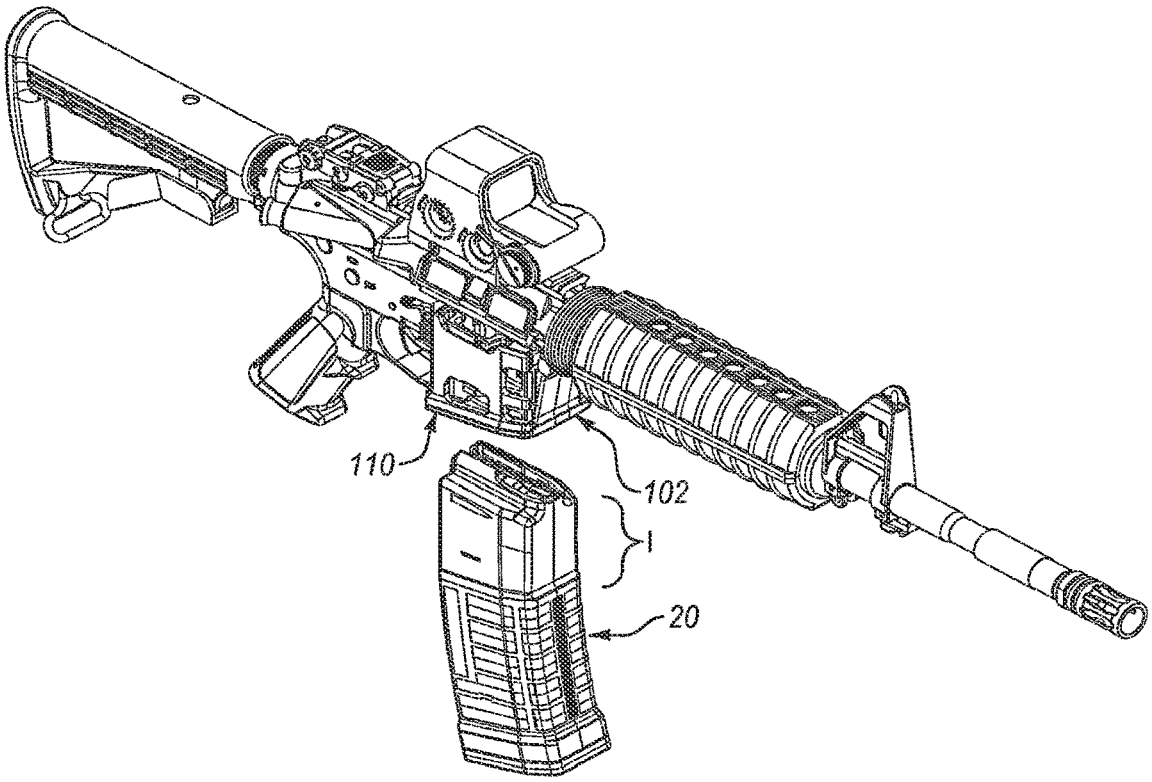
FIG. 1C illustrates the detachable magazine of FIG. 1A detached from the firearm.

Referring now to FIG. 1C, the magazine well 102 defines a magazine receiving recess 110. In at least one example, the magazine well 102 is configured to receive four stacks of cartridges therein, each cartridge (not shown) having a width corresponding to the width 34 (FIG. 1C) of the nominal round 30 (FIG. 1B). As such, at least a portion of the magazine well 102 may have a width that is greater than three times the width 34 (FIG. 1C) of a nominal round (FIG. 1C), such as greater than four times the width 34 (FIG. 1C) of the nominal round 30 (FIG. 1C). Such width may be relatively constant throughout the magazine receiving recess 110 in the magazine well 102.

Figure 7A:
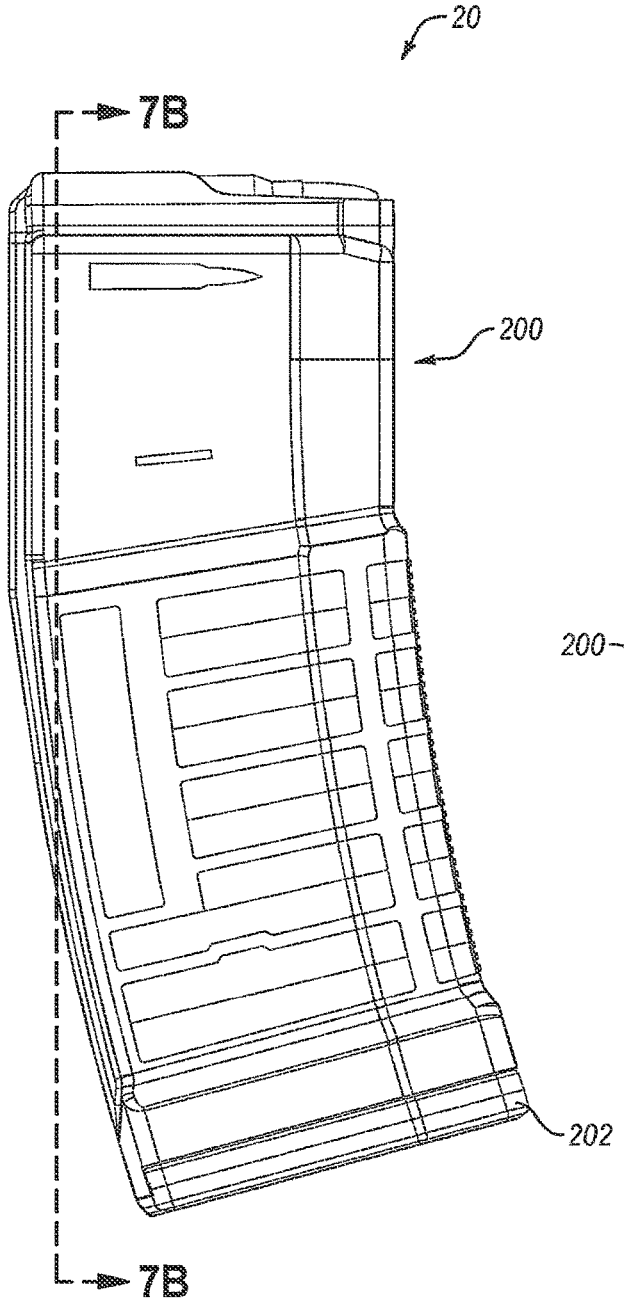
FIG. 7A is a side view of a detachable magazine in which several cartridges are loaded into the detachable magazine.
Figure 7B:
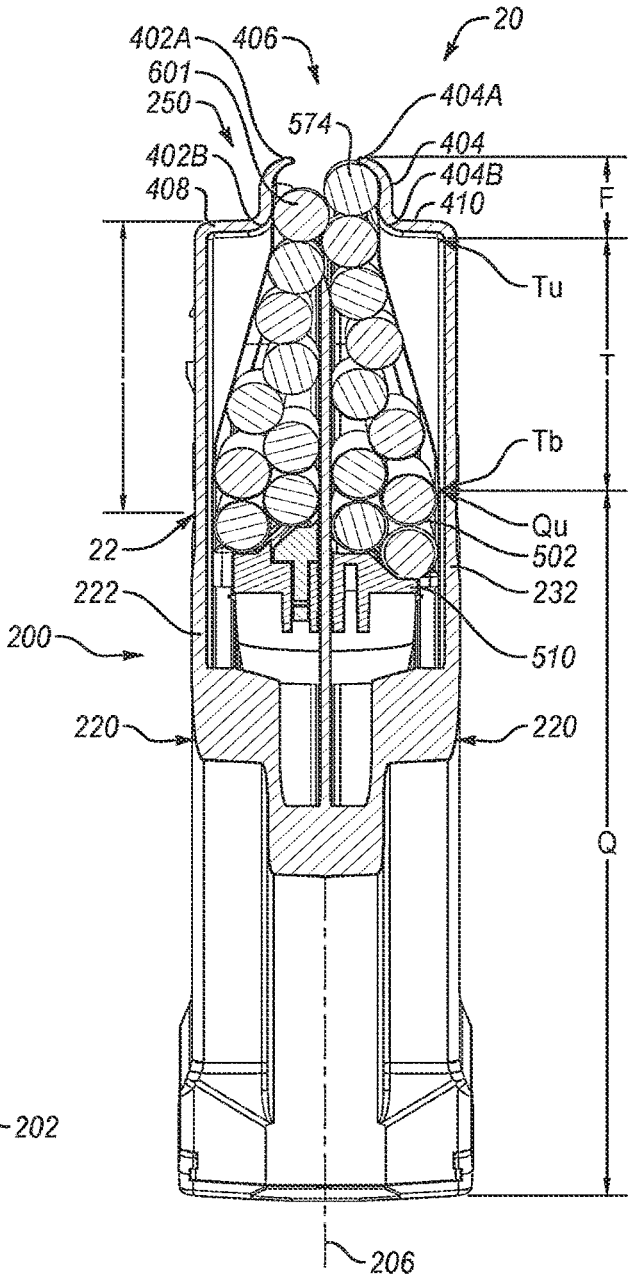
FIG. 7B is a cross-sectional view of the detachable magazine taken along section 7B-7B of FIG. 7A in which one round is loaded into the detachable magazine.

As a result, the magazine well 102 may be sufficiently wider than two double stacks of cartridges 601 (FIG. 7B) to allow the detachable magazine 20 to have an interior volume, at least a portion of which, is configured to hold four rows of cartridges 601 (FIG. 7B) arranged in two double rows of cartridges 601 (FIG. 7B). Such a configuration of the lower receiver 101 allows for four rows of cartridges 601 (FIG. 7B) to be placed within the lower receiver 101 such that four rows of cartridges 601 (FIG. 7B) may be placed within the magazine well 102 rather than the two rows typically fit in conventional AR-15 magazine wells.

As shown in FIGS. 1A and 1C, when the detachable magazine 20 is inserted partially into the magazine well 102 to couple the magazine 20 to the lower receiver assembly 100, a portion of the detachable magazine 20 corresponding to an insertion region I (FIG. 1C) will be inserted into the magazine well 102 such that the detachable magazine 20 is inserted up to an insertion depth line 22 as will be described in more detail hereinafter.

One exemplary detachable magazine 20 will be discussed herein after that allows four rows of cartridges 601 (FIG. 6B) to be stored not only within a portion of the detachable magazine 20, but to be stored in a portion of the detachable magazine 20 that is received within the magazine well 102. Further, the detachable magazine 20 described in more detail hereinafter is configured to operate with standard AR-15 pattern upper assemblies. Accordingly, detachable magazines discussed hereinafter are configured to transition from a four row configuration to a two row configuration to allow the detachable magazine 20 to feed a conventional AR-15 pattern upper receiver assembly.

Figure 2A:
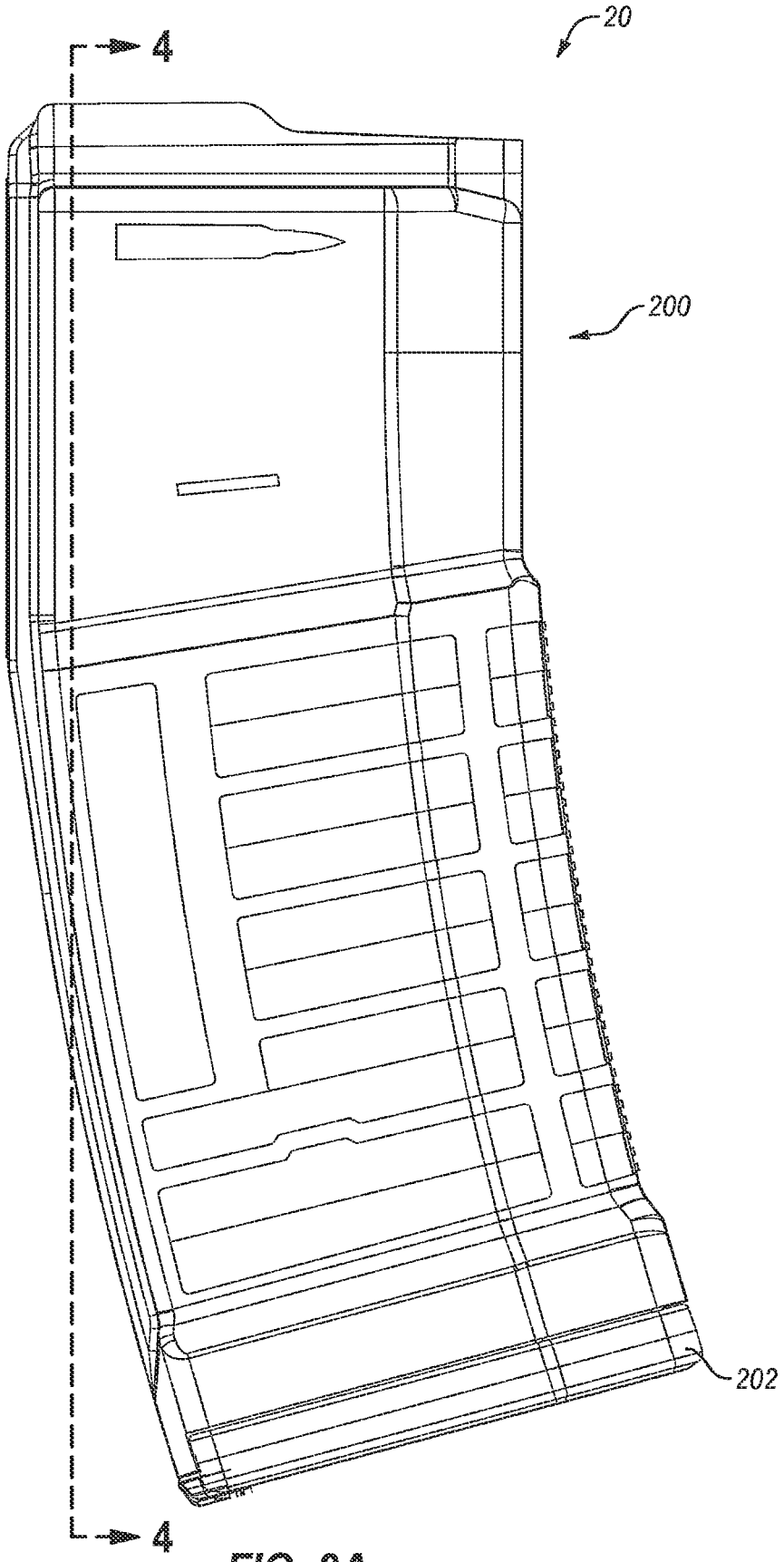
FIG. 2A is a side view of a detachable magazine shown in FIG. 1B.
Figure 3A:
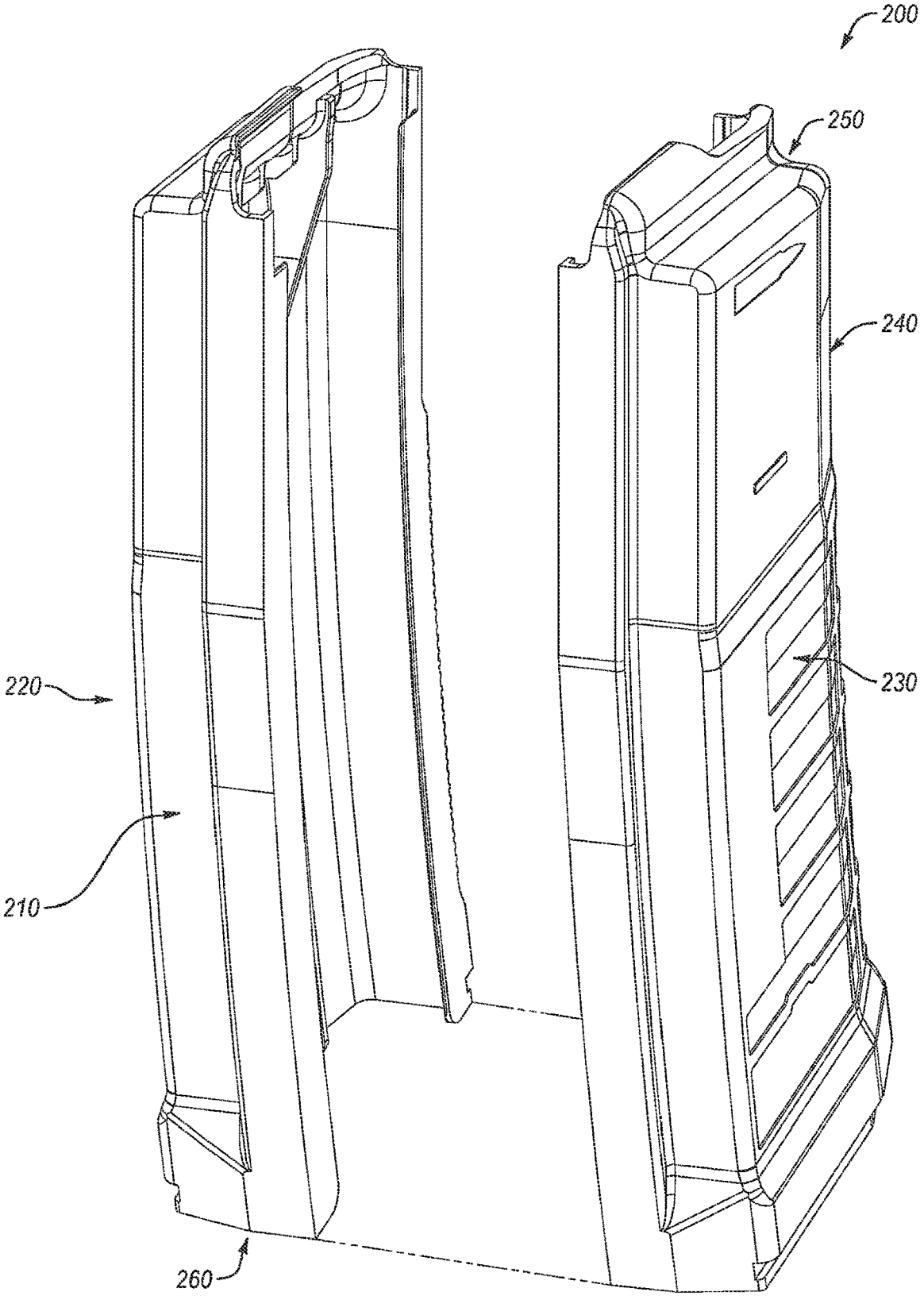
FIG. 3A is an exploded view of a magazine body shown in FIG. 2B.

FIG. 2A is a side view of the detachable magazine 20. As shown in FIG. 2A, the detachable magazine 20 generally includes a magazine body 200 and a floor plate 202. As shown in FIG. 3A, the magazine body 200 further includes a rear portion 210, a first side or left portion 220, a second side or right portion 230 that define a cartridge receiving recess therein 204 (best seen in FIG. 3B). The magazine body 200 further includes a front portion 240 as well as a top portion 250 and a bottom portion 260.

Figure 2B:
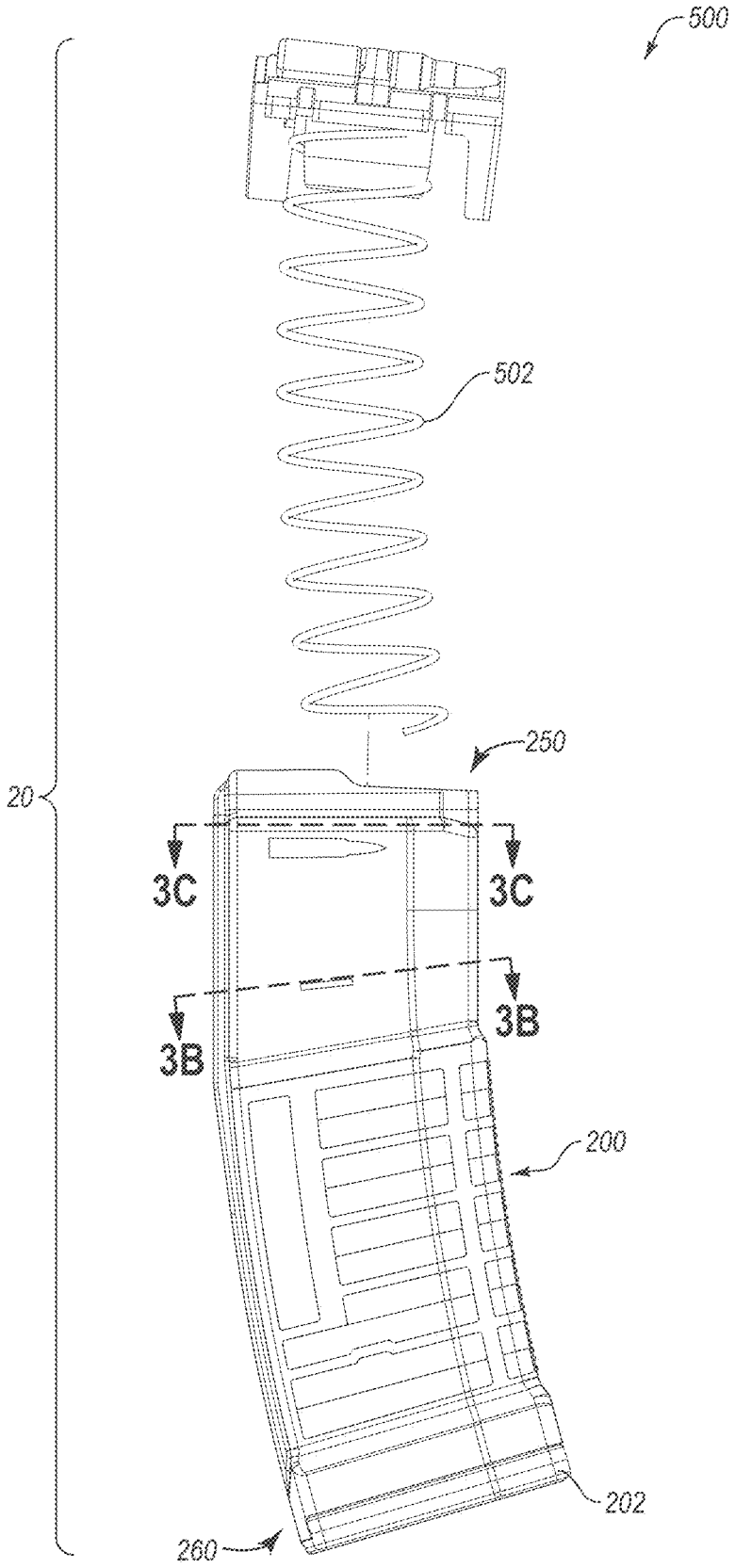
FIG. 2B is an exploded view of the detachable magazine of FIG. 2A.

As shown in FIG. 2B, the detachable magazine 20 also includes a follower assembly 500, and a follower spring 502. The floor plate 202 is coupled to the bottom portion 260 of the magazine body. The follower assembly 500 is placed within the magazine body 200 and the follower spring 502 is placed between the follower assembly 500 and the floor plate 202 such that the follower spring 502 is compressed therebetween when the detachable magazine 20 is assembled. Such a configuration causes the follower spring 502 to exert a biasing or lifting force against the follower assembly 500 to urge the follower assembly 500 away from the floor plate 202 and toward the top portion 250 of the magazine body 200.

Figure 3C:
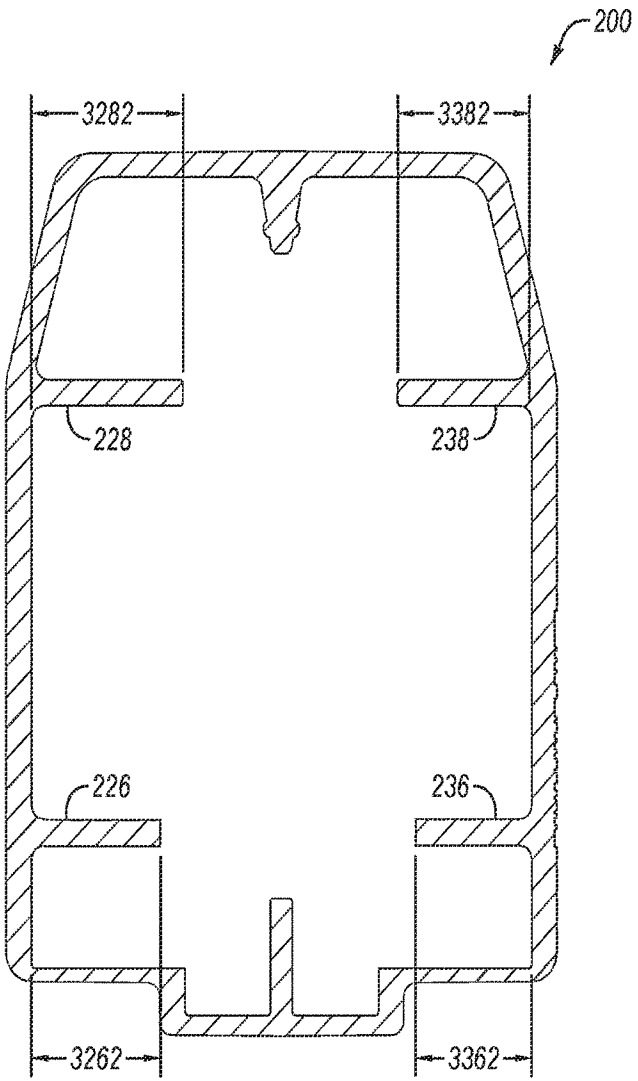
FIG. 3C is a cross sectional view of the magazine body shown in FIGS. 2B and 3A taken along section 3C-3C of FIG. 2B.
Figure 3B:
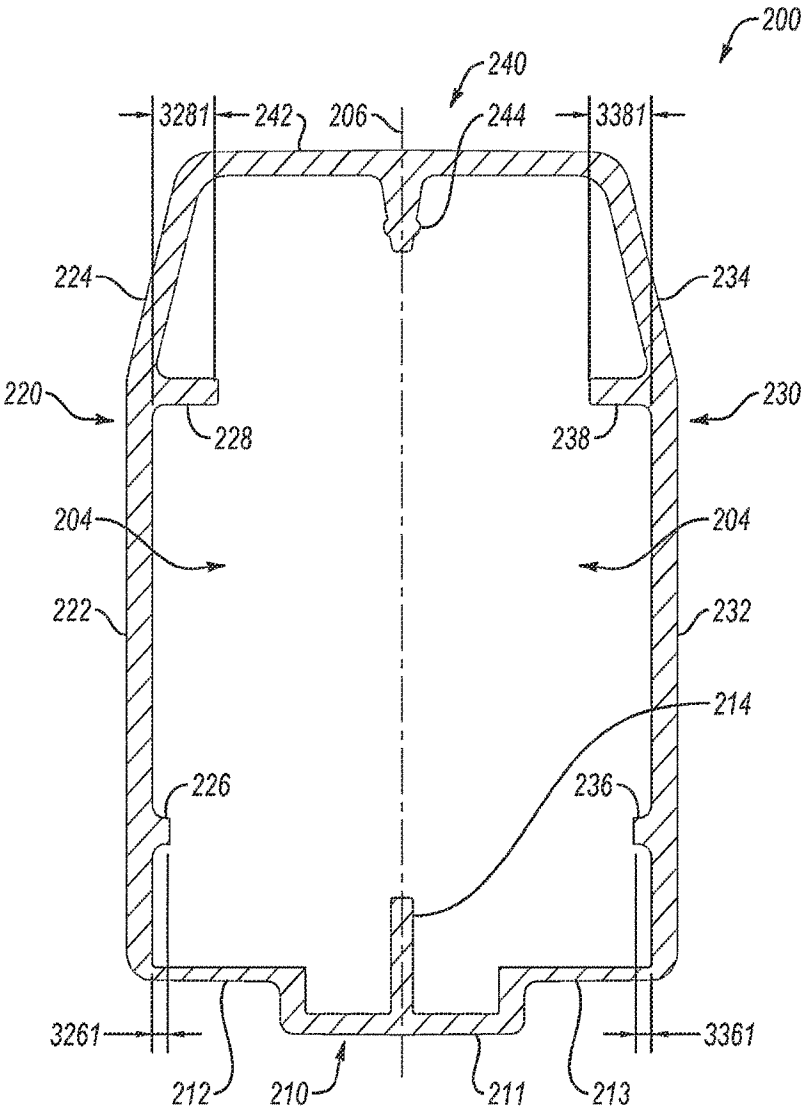
FIG. 3B is a cross sectional view of the magazine body shown in FIGS. 2B and 3A taken along section 3B-3B of FIG. 2B.

Referring now to FIGS. 3B and 3C, a central magazine plane 206 is defined between the left portion 220 and the right portion 230. The 220 includes a left primary sidewall 222 and a right primary sidewall 232 that extend away from the rear portion 210 of the magazine body 200. As shown in FIGS. 3B and 3C, front portion 240 includes a front wall 242.

In the illustrated example, the left primary sidewall 222 and the right primary sidewall 232 are each generally parallel to the central magazine plane 206. An angled left sidewall 224 extends away from the left primary sidewall 222 and intersects with the front wall 242. An angled sidewall 234 also extends away from the right primary sidewall 232 and also intersects with the front wall 242. The right sidewall 234 extends from the right primary sidewall 232 and toward the central magazine plane 206 as shown.

The rear portion 210 includes a rib support rear wall 211 as well as left rear wall 212 and a right rear wall 213. In the illustrated example, the left rear wall 212 intersects with the left primary sidewall 222 while the right rear wall 213 intersects with the right primary sidewall 232.

The rib support rear wall 211 is coupled to the left rear wall 212 and the right rear wall 213 by shoulders 212A, 212B, but is spaced apart rearwardly from the left rear wall 212 and the right rear wall 213. The rear portion 210 includes a rear ridge portion 214 that extends from the rib support rear wall 211 toward the front portion 240.

In the illustrated example, the magazine body 200 includes a plurality of ribs that guide and stabilize and guide the follower assembly 300 (FIG. 2B) and cartridges as cartridges are loaded into and fed from the detachable magazine 20.

Referring again to FIG. 3B, these features include at least one central rib portion, such as rear rib 214 or front rib portion 244, which are oriented along the central magazine plane 206. In the illustrated example, front rib portion 244 extends away from the front wall 242 toward the rear rib 214.

Referring still to FIGS. 3B and 3C, the magazine body 200 also includes at least one left lateral rib, such as rear left lateral rib 226 or front left lateral rib 228, extending away from left portion 220, such as away from left primary sidewall 222 and toward the central magazine plane 206. These features may also include at least one right lateral rib, such as rear right lateral rib 236 or front right lateral rib 238, extending away from the right portion 230, such as away from the right primary sidewall 232 and toward the central magazine plane 206.

Figure 4:
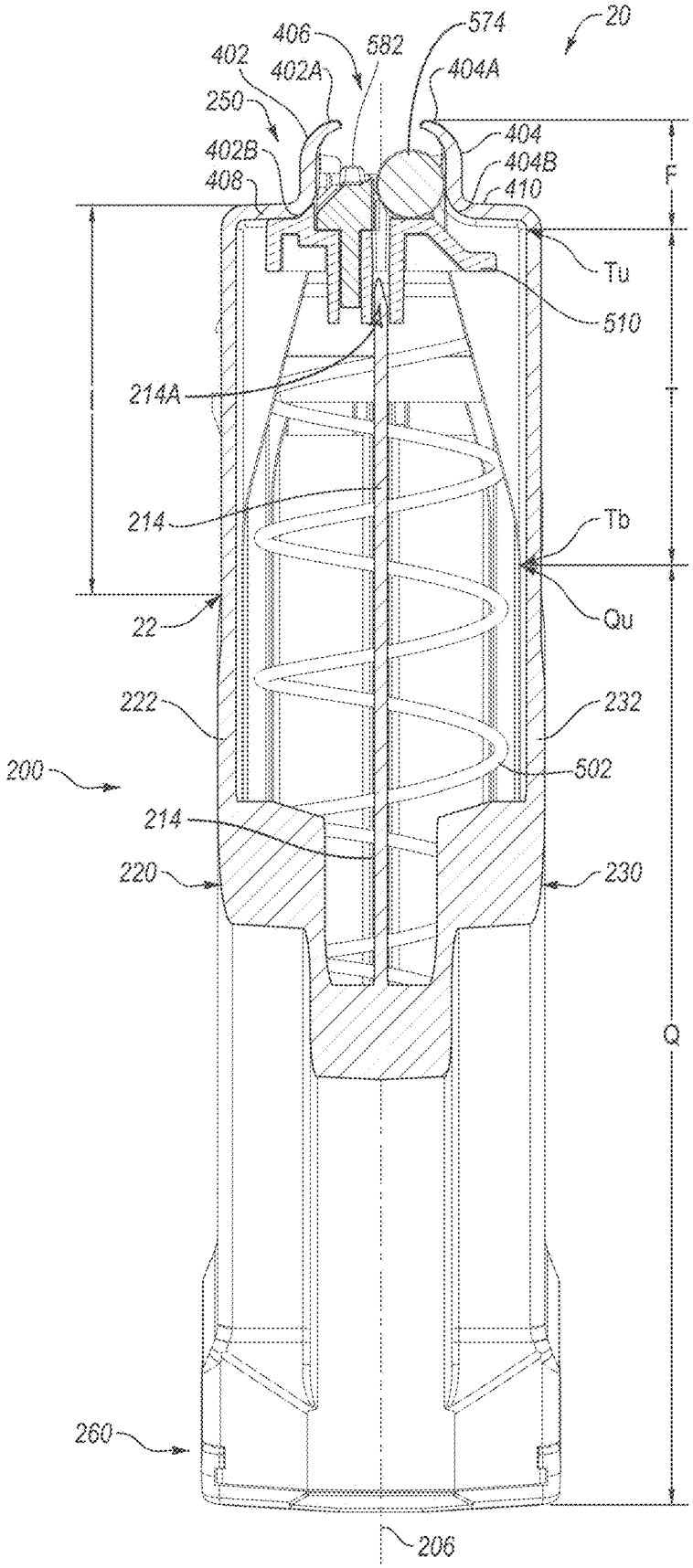
FIG. 4 is a cross sectional view of the detachable magazine shown in FIG. 2A taken along section 4A-4A wherein the detachable magazine is unloaded.

Referring simultaneously to FIGS. 2A and 4, such a configuration causes the magazine body 200 to have a four-stack region Q, a transition region T, a feed region F, and a insertion region I.

As shown in FIG. 4, the top portion 250 of the magazine body 200 generally includes feed lips 402, 404 each having an upper end 402A, 404A and a lower end 402B, 402B to thereby define a feed slot 406 therebetween. The top portion 250 also includes upper shoulders 408, 410 that extend from the feed lips 402, 404 to the left portion 220, 230 and to the left primary sidewall 222 and right primary sidewall 232 as shown in the drawings. In the illustrated example, the feed region F is formed from the upper ends 402A, 404A of the feed lips 402, 404 to the lower ends 402B, 404B of the feed lips 402, 404.

Figure 6A:
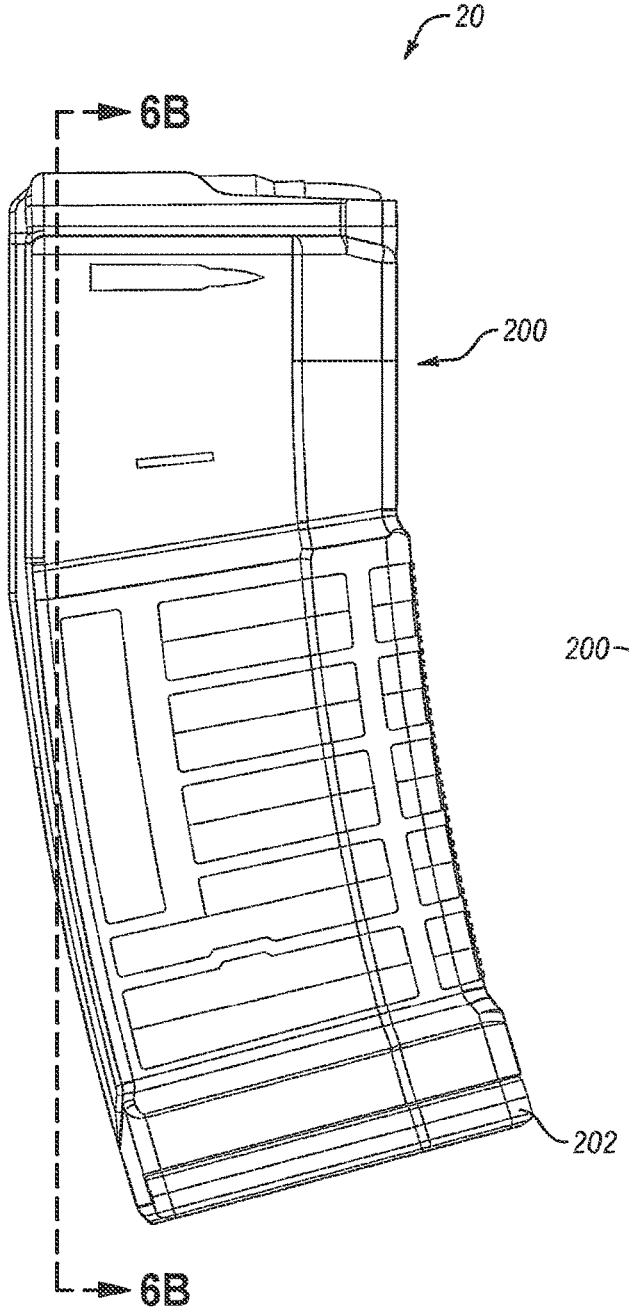
FIG. 6A is a side view of a detachable magazine in which one cartridge is loaded into the detachable magazine.
Figure 6B:
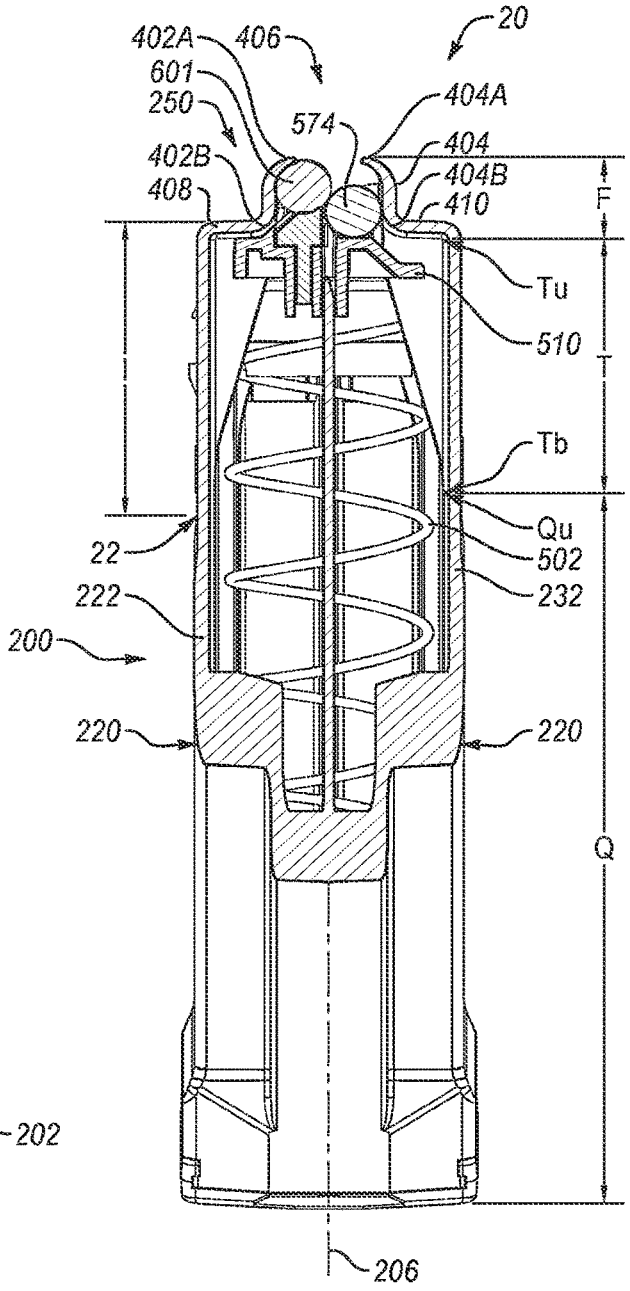
FIG. 6B is a cross-sectional view of the detachable magazine taken along section 6B-6B of FIG. 6A in which one cartridge is loaded into the detachable magazine.

In the feed region F, cartridges 601 (FIG. 6B) are stacked on alternating sides of the central magazine plane 206 while in contact with one of the feed lips 402, 404 and an adjacent cartridge: 601 (FIG. 6B). Such a configuration moves a cartridge 601 (FIG. 6B) into the feed slot 406 while in contact with either of the feed lips 402, 404 as is known in the art.

Below the feed region R, the transition zone T extends to a point where cartridges 601, (FIG. 7B) are aligned in two rows of double stacked cartridges 601, (FIG. 7B) on opposing sides of the central magazine plane 206 and opposing sides of rear rib 214 and/or the front rib 244 (FIG. 3B). The cartridges 601, (FIG. 7B) are guided and constrained to move between a single alternating double stack to two opposing double stacks in the quad stack region Q by the lateral ribs 226, 228, 236, 238 described above (FIG. 3B). Accordingly, the transition region T is associated with the variable distance of the lateral ribs 226, 228, 236, 238 (FIG. 3B) as will described in more detail.

Referring simultaneously to FIGS. 3B, 3C, and 4, the lateral ribs 226, 228, 236, 238 may have a relatively constant size within the four-stack region Q, which extends from the bottom portion 260 of the magazine body 200 to the upper end Qt of the quad-stack region Q. A lower end of the transition region Tb corresponds to the upper end Qt of the quad-stack region Q. Section 3B is a section view of the lower end of the transition region Tb.

As shown particularly in FIG. 4, a top end 214A of the rear rib 214 extends into the transition region T such that the top end 214A is between the upper end of the transition region Tu and the lower end of the transition region Tb.

With reference again to FIGS. 3B, 3C and 4, the rear right lateral rib 236 extends a first rear right lateral distance 3361 from the right primary sidewall 232 of the magazine body 200 but transitions from the first rear right lateral distance 3361 (FIG. 3B) at the lower end Tb of the transition region T to a second rear right lateral distance 3362 at an upper end Tu of the transition region T. The second rear right lateral distance 3362 is greater than the first rear right lateral distance 3361.

In at least one example, the front right lateral rib 238 extends a first front right lateral distance 3381 (FIG. 3B) from the primary right sidewall 232 that is relatively constant throughout the first or quad-stack region Q of the magazine body 200 but transitions from the first front right lateral distance 3381 (FIG. 3B) at the lower end Tb of the transition region T to a second front right lateral distance 3382 at the upper end Tu of the transition region T. The second front right lateral distance 3382 is greater than the first front right lateral distance 3381.

In at least one example, the rear left lateral rib 226 extends a first rear left lateral distance 3261 from the primary left sidewall 222 that is relatively constant throughout the first or quad-stack region Q of the magazine body 200 but transitions from the first left right lateral distance 3261 at the lower end Tb of the transition region T to a second rear left lateral distance 3262 at the top of the transition region. The second rear left lateral distance 3262 is greater than the first rear left lateral distance 3261.

In at least one example, the front left lateral rib 228 extends a first front left lateral distance 2381 from the left primary sidewall 222 that is relatively constant throughout the first or quad-stack region Q of the magazine body 200 but transitions from the first front left lateral distance 3281 at the lower end Tb of the transition region T to a second front left lateral distance 3282 at the upper end Tu of the transition region T. The second front left lateral distance 3281 is greater than the first front left lateral distance 3282.

As shown in FIGS. 3B-3D, in at least one example, the first front right lateral distance 3381 is greater than the first rear right lateral distance 3361. It at least one example, the first front left lateral distance 3281 is greater than the first rear left lateral distance 3261. It at least one example, the second front right lateral distance 3382 is greater than second rear right lateral distance 3362. It at least one example, the second front left lateral distance 3382 is greater than the second rear left lateral distance 3262.

Referring again to FIG. 4, the length of the insertion region I measured from the bottom ends 402B, 404B of the feed lips 402, 404 to the insertion depth line 22 is less than a transition length as measured from the upper end Tu of the transition region to the bottom end Tb of the transition region T.

As also shown in FIG. 4, the rear rib 214 may have a relatively constant thickness through its length, but may end short of the upper end Tu of the transition region T. Similarly, the front rib 244 (FIG. 3B) may have a relatively constant thickness throughout its length. The follower assembly 500 (FIG. 2B) is configured to engage the various lateral ribs 226, 228, 236, 238 (FIGS. 3B-3C) to facilitate loading of cartridges 601 (FIG. 6B) in the detachable magazine 20 and feeding therefrom.

Figure 5A:
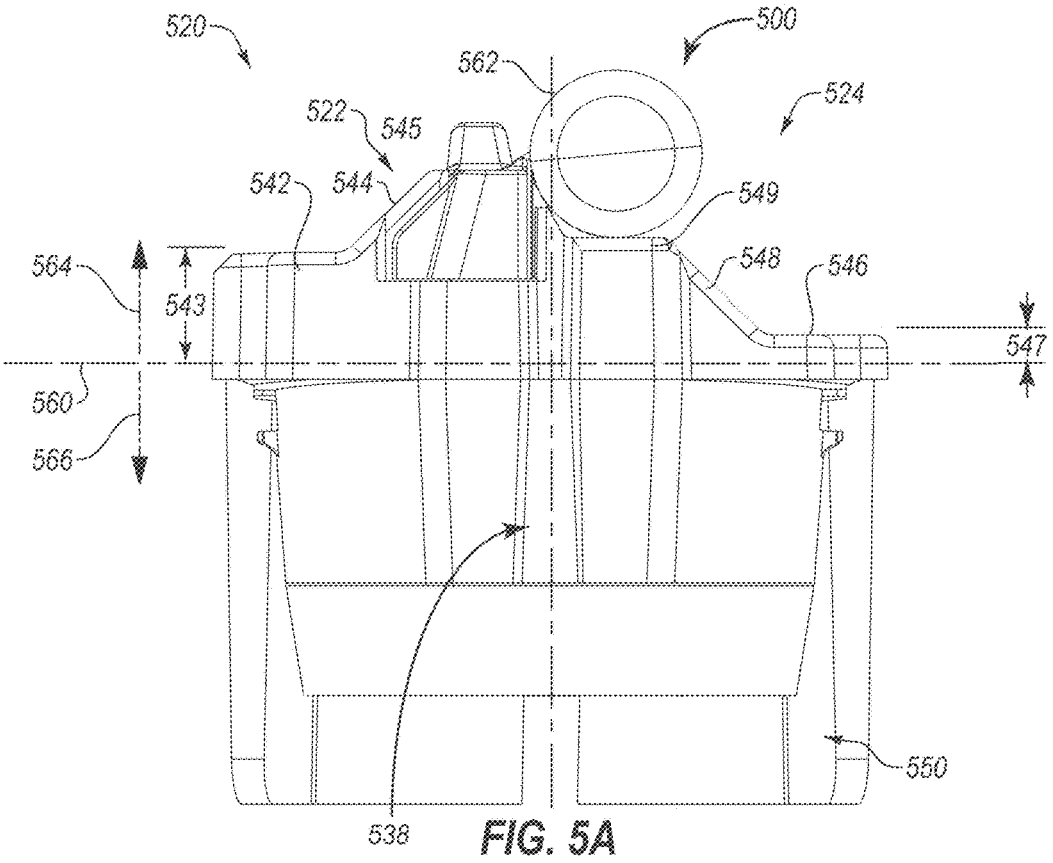
FIG. 5A is a rear view of a follower assembly.
Figure 5B:
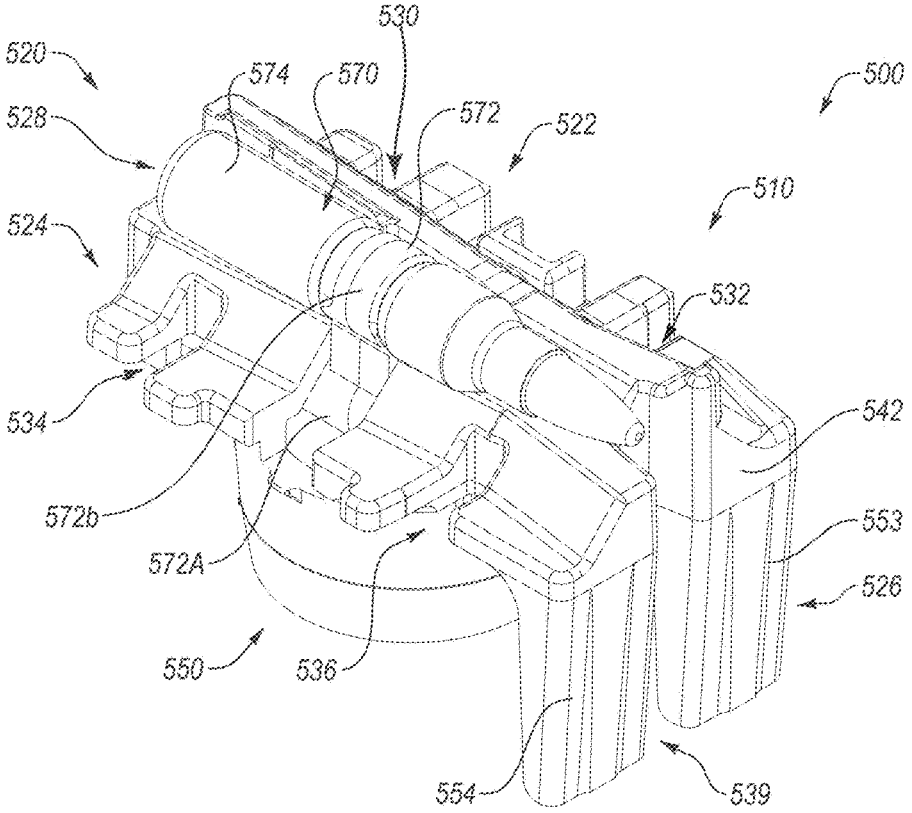
FIG. 5B is perspective view of a follower assembly of FIG. 5A.

Referring now to FIGS. 5A and 5B, the follower assembly 500 generally includes a follower body 510 having an upper portion 520 and a lower portion 550 which extend in opposing directions away from a follower reference plane 560. The follower reference plane 560 is perpendicular to a central follower plane 562. The central follower plane 562 is generally aligned with the central magazine plane 206 (best seen in FIG. 4) when the detachable magazine 20 (also best seen in FIG. 4) is assembled.

In the illustrated example, the upper portion 520 extends in a first direction 564 from the follower reference plane 560 while the lower portion 550 extends in a second direction 566 from the follower reference plane 560, the first direction 564 being opposite the second direction 566.

As introduced, the lower portion 550 of the follower body 510 extends from the follower reference plane 560 in the second direction 566. The lower portion 550 includes a spring engagement portion 552 that is configured to be received within or otherwise couple the follower body 510 to a biasing member, such as the follower spring 502 (best seen in FIG. 2B) as described above.

As shown in FIGS. 5A and 5B, the upper portion 520 generally includes a first or left side 522 and a second or right side 524 as well as a front portion 526 and a rear portion 528. A rear left rib slot 530 is defined in the left side 522 and is configured to receive and engage the rear left lateral rib 226 (FIG. 3B-3C) described above. A front left rib slot 532 is defined in the left side 522 and is configured to receive and engage the front left lateral rib 228 (FIGS. 3B-3C).

A rear right rib slot 534 is defined in the right side 524 and is configured to receive and engage the rear right lateral rib 236. (FIGS. 3B-3C). A front right rib slot 536 is defined in the right side 524 and is configured to receive and engage the front right lateral rib 238 (FIGS. 3B-3C). A rear rib slot 538 is defined in the rear portion 528 and is configured to receive and engage the rear rib 214 (FIGS. 3B-3C) while a front rib slot 539 is defined in the front portion 526 to receive and engage the front rib 244 (FIGS. 3B-3C). Engagement between the various ribs and the slots described above help constrain the movement of the follower assembly 500 as it moves within the magazine body 200.

In addition to containing slots and other features to help constrain the movement of the follower assembly 500, the follower body 510 is further configured to guide and constrain the movement and position of cartridges 601 (FIG. 6B). As previously discussed, the upper portion 520 of the follower body 510 generally includes a first or left side 522 and a second or right side 524. As shown in FIG. 5A, the first or left side 522 has a first support platform 542 offset a first support platform distance 543 away from the follower reference plane 560.

Figure 5C:
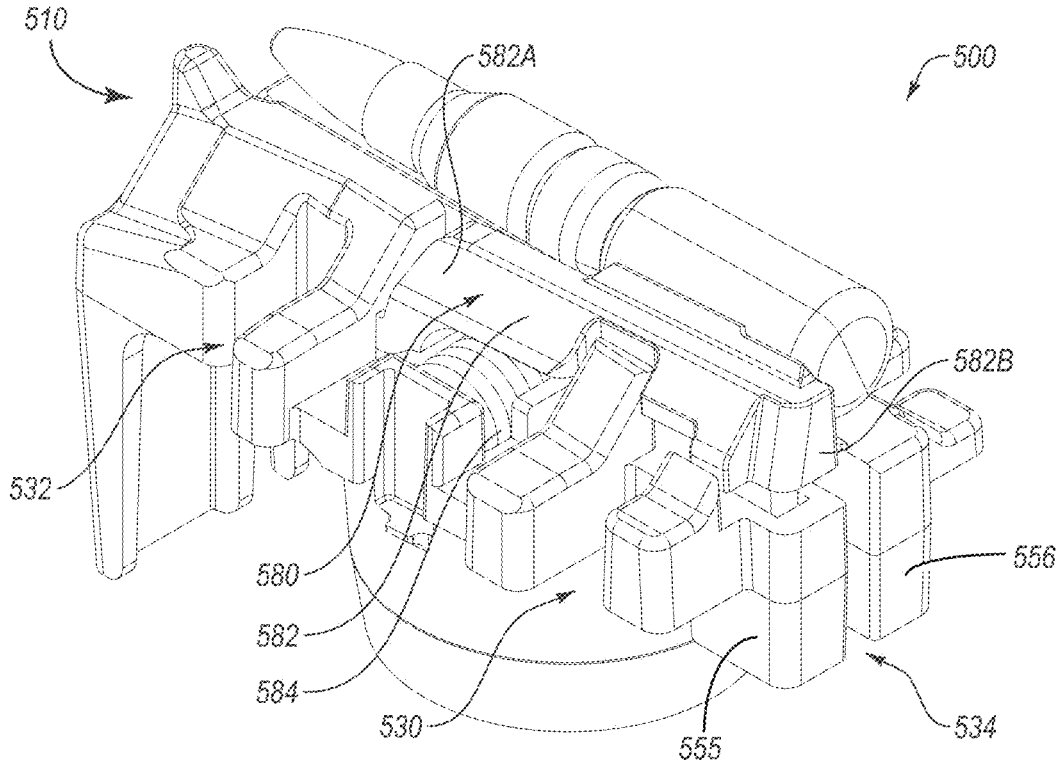
FIG. 5C is another perspective view of the follower assembly of FIGS. 5A-5B.
Figure 5D:
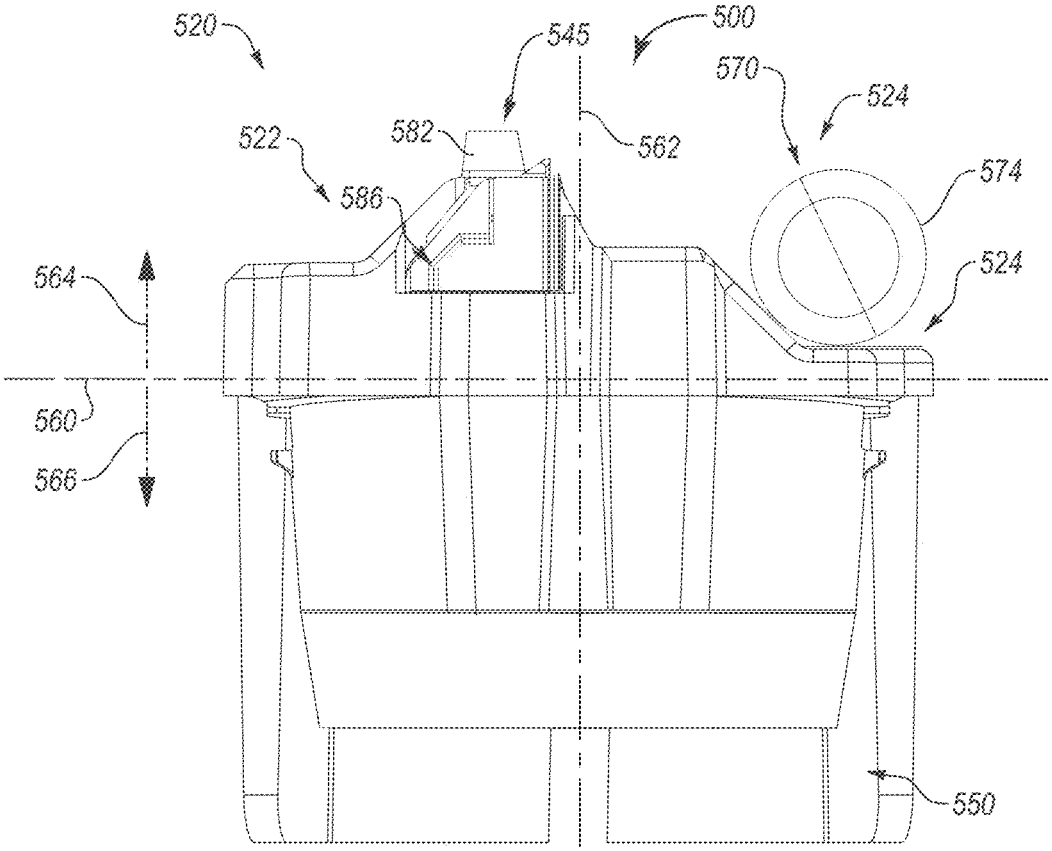
FIG. 5D is a rear of the follower assembly of FIGS. 5A-5C.

A first support ramp 544 extends from the first support platform 542 away from the follower reference plane 560 and toward the central follower plane 566 as shown in FIGS. 5A and 5D. In at least one example, a top first platform 545 extends further away from the first support ramp 544.

The second or right side 524 has a second support platform 546 offset a second support platform distance 547 away from the follower reference plane 560. A second support ramp 548 extends from the second support platform 546 away from the follower reference plane 560 and toward the central follower plane 562 as shown. The second or right side 524 may also include a top second platform 549 extending away from the second support ramp 548. The second support platform distance 547 is less than the first platform support distance 543. Though shown as left and right, it will be appreciated that the configuration could be mirrored while remaining equivalent in functional respects.

As shown in FIGS. 5B and 5C, the lower portion 550 of the follower body 510 may further include one or more bearing support surfaces, such as forward legs 553, 554 and rearward legs 555, 556 that extend away from follower reference plane 560 in the second direction 566.

Referring again to FIGS. 5A and 5B, the follower assembly 500 includes a dummy round assembly 570. The dummy round assembly 570 is rotatingly coupled to the second or right side 524 of the upper portion 520 of the follower body 510. In particular, the dummy round assembly has a link 572 having a first end 572A pivotingly coupled to the second side 524 of the upper portion 520 of the follower body 510, such as at the second support ramp 548 as shown. A second end 572B of the link 572 is also pivotingly coupled to a dummy round 574. The dummy round 574 provides support and positions cartridges for feeding as will be described hereinafter at the appropriate point.

The link 572 allows the dummy round 574 to rotate between the position shown in FIG. 5A, which may be described as a first position, and a second position shown in FIG. 5D. Referring now simultaneously to FIGS. 5A and 5D, in the first position shown in FIG. 5A, the dummy round 574 is relatively closer to the central follower plane 562 and further away from the follower reference plane 562 than the dummy round 560 is in the second position shown in FIG. 5D.

Referring again to FIGS. 5B and 5C, the follower assembly 500 further includes a bolt catch mechanism 580. The bolt catch mechanism 580 generally includes a bolt catch 582 and a biasing member 584. In at least one example, the bolt catch 582 is rotatingly coupled to the follower body 510. More specifically, a front end 582A of the bolt catch may be rotatingly coupled to the follower body 510 while a second end or rear end 582B is allowed to rotate relative to the front or first end 582A.

As shown in FIGS. 5C and 5D, the upper portion 520 of the follower body 510 has a bolt catch recess 586 defined therein to receive at least a portion of the bolt catch 582 to allow the bolt catch 582 to pivot flush with a portion of the upper portion 520 of the follower body 510 when a cartridge 601 (FIG. 6B) is in place. In at least one example, the bolt catch recess 586 (FIG. 5D) is defined in the top first platform 545 on the first side 522. As a result, the bolt catch 582 may be moved flush with the top first platform 545 when a cartridge 601 (FIG. 6B) is in place.

In at least one example, the bolt catch 582 is positioned on an opposing side of the central follower plane 562 relative to the dummy round 574. The bolt catch 582 only extends away from the follower body 510 when feeding of cartridges is complete, not as part of the feeding process. Further, in one example the second end 582B of the bolt catch 582 in the illustrated example extends away from the follower body 510 as the first end 582A is at a relatively fixed position that is offset from the follower reference plane 560.

As will be discussed in more detail hereinafter, the entire follower assembly 500, including the bolt catch mechanism 580 and the dummy round assembly 570, move together as the follower assembly 500 facilitates the loading and feeding of cartridges 601 (FIG. 6B) into and out of the detachable magazine 20 (FIG. 6B).

Referring now to loading of the detachable magazine 20, as shown in the FIG. 4 when the detachable magazine 20 is empty, the follower spring 502 pushes the follower assembly 500 toward the top portion 250 of the magazine body 200 such that the dummy round 574 is in contact with feed lip 404 such that the follower assembly 500 is in the feed region F. In that position, the bolt catch 582 is allowed to rotate to away from the follower body 510 in such a position that it would engage a bolt catch in a firearm if the bolt were cycled, as is well known in the art.

Referring simultaneously to FIGS. 3E, 4 and 5B, at that position, the rear left lateral rib 226, the front left lateral rib 228, the rear right lateral rib 236, and the front right lateral rib 238 extend a maximum amount into the rear left rib slot 530, the front left rib slot 532, the rear right rib slot 534 and the front right rib slot 536 (all shown in FIGS. 5A and 5B) respectively. The rear rib 214 may not extend into contact with the follower body 510 at that position.

As a cartridge 601 is fed into the magazine as shown in FIGS. 6A and 6B, the bolt catch (FIG. 5A) is depressed before or as cartridge 601 engages the follower body 510. As cartridge 601 is fed into the detachable magazine 20, the cartridge 601 contacts the dummy round 574 on one side. The dummy round 574 is constrained from rotation by its contact with the second or right rear lateral rib 236 (FIG. 3B) as well as the contact with the second or right front lateral rib 238 (FIG. 3B). As such, the force acting against the dummy round 574 acts on the follower body 510 in opposition to the biasing force exerted by the follower spring 502 to provide the space for the first cartridge 601 to be contained in the detachable magazine 20. When the loading force is removed, the first cartridge 601 then comes into contact with the feed lip 402 on one side while remaining in contact with the dummy round 574 and top first platform 545 (FIG. 5A).

As shown in FIGS. 7A and 7B, feeding of additional cartridges 601 against the previously fed cartridges 601 and the dummy round 574 to move the additional cartridges 601 into engagement with the feed lips 402, 404 and adjacent cartridges. Contact between cartridges 601 adjacent the dummy round 574 exerts a force on the dummy round 574 to urge the dummy round 574 away from the central magazine plane 206 and toward the right portion 230 of the magazine body 200. As the dummy round 574 is urged toward the right portion 230, the movement of the dummy round 574 is constrained by contact and engagement with the rear right lateral rib 236 and front right lateral rib 238 (both best seen in FIG. 3D).

As seen in FIG. 3D, the rear right lateral rib 236 and the front right lateral rib 238 transition in the distance they extend away from the right portion 230 of the magazine body 200. Referring again to FIGS. 7A and 7B, a configuration allows the dummy round 574 to move toward further toward right portion 230 until it is in the position shown in FIG. 7B. The dummy round 574 moves from the first position (FIG. 5A) to the second position as it moves through the transition region T due to engagement between adjacent cartridges (601) and the rear right lateral rib 236 and the front right lateral rib 238 (FIG. 3D).

When three or more cartridges are fed into the detachable magazine 20, cartridges 601 will begin engaging central ribs, including rear rib 214 (FIG. 3B) and front rib 244 (FIG. 3B). This engagement. In particular, with reference to FIGS. 5A-5D, the follower assembly 500, including is offset between the left side 522 and right side 523 relative to the follower reference plane 560.

Referring again to FIG. 7B, such a configuration causes the rounds to be slightly offset to one side or the other of the central magazine plane 206 with the offset alternating between slightly toward the left portion 220 or the right portion 230. As cartridges are fed into the detachable magazine 20, they will come into contact with the rear rib 214 (FIG. 3B) and the front rib 244 (FIG. 3B). Depending on their offset as described above, the cartridges 601 are then guided into opposing sides of the central magazine plane 206 and the rear rib 214 (FIG. 3B) where they are doubled stacked within the quad stack region Q.

In each instance, the follower assembly contacts and guides cartridges through the quad stack region and into the transition region. In particular, the follower body travels through both regions and the bolt catch does not extent until the magazine is empty.

As rounds are fed from the magazine, the follower body moves toward the top of the magazine body. As the follower body moves toward the top of the magazine body, the dummy round comes into engagement with the ribs in the transition zone, which move the dummy round toward the central plane and back toward the position described above as the magazine is emptied.

As shown in the figures, the transition zone is shorter than the length of the typical engagement between a magazine and a typical AR-15 magazine well. As such, the magazine is configured to place four rows of cartridges within an associated receiver, rather than just outside the receiver.

What is claimed is:

1. A detachable magazine for firearms, comprising:

a magazine body having a top portion having a feed region formed therein, a bottom portion, a left sidewall extending from the top portion to the bottom portion, a right sidewall extending from the top portion to the bottom portion, the right sidewall being spaced apart the left sidewall to define a magazine body recess, the left sidewall and the right sidewall being generally parallel to each other, and wherein a central magazine plane is defined between the left sidewall and the right sidewall, wherein the magazine body further includes a transition region in communication with the feed region, and a quad stack region in communication with the transition region; and a follower assembly having a follower body, the follower body being configured to be received at least partially within the magazine body recess, the follower assembly being configured to travel through both the quad stack region and the transition region and into communication with the feed region.

2. The detachable magazine of claim 1, further including at least one left lateral rib extending away from the left sidewall and toward the central magazine plane and at least one right lateral rib extending away from the right sidewall and toward the central magazine plane.

3. The detachable magazine of claim 2, wherein the transition region has an upper end and a lower end, wherein the at least one left lateral rib extends a lower left lateral distance from the left sidewall toward the central magazine plane at the lower end of the transition region and transitions to extend an upper left lateral distance from the left sidewall toward the central magazine plane at the upper end of the transition region, the upper left lateral distance being greater than the lower left lateral distance, and wherein the at least one right lateral rib extends a lower right lateral distance from the right sidewall toward the central magazine plane at the lower end of the transition region and transitions to extend an upper right lateral distance from the right sidewall toward the central magazine plane at the upper end of the transition region, the upper right lateral distance being greater than the lower right lateral distance.

4. The detachable magazine of claim 3, wherein the follower body includes a follower reference plane, the follower body further including an upper portion extending away from the follower reference plane in a first direction and a lower portion extending in a second direction away from the follower reference plane, the second direction being opposite the first direction, the upper portion having a left side and a right side as well a front and a rear, wherein at least one left rib slot is defined in the left side and at least one rib slot is defined in the right side, the at least one left rib slot being configured to receive the at least one left lateral rib and the at least one right rib slot being configured to receive the at least one right lateral rib.

5. The detachable magazine of claim 4, wherein the magazine body further includes an insertion region, the insertion region having an insertion length and the transition region having a transition length, the insertion length being greater than the transition region.

6. The detachable magazine of claim 4, wherein a central follower plane is defined between the left side and the right side of the upper portion, the follower assembly further including a dummy round link rotatingly coupled to the upper portion of the follower body, the dummy round link being further rotatingly coupled to a dummy round, the dummy round being oriented parallel to the central follower plane, wherein the dummy round link is configured to allow the dummy round to move between a first position and a second position, wherein the dummy round is relatively closer to the central follower plane in the first position than in the second position.

7. The detachable magazine of claim 6, wherein the follower assembly further includes a bolt catch mechanism coupled to the upper portion of the follower body, the bolt catch mechanism including a bolt catch and a biasing member, wherein the bolt catch includes a front end and a rear end, the front end of the bolt catch being rotatingly coupled to the front of the upper portion of the follower body, while the rear end is configured to rotate relative to the front end of the bolt catch, the biasing member being configured to exert a biasing force on the second end of the bolt catch urge the second end of the bolt catch away from the follower reference plane.

8. The detachable magazine of claim 7, wherein the bolt catch is positioned on an opposing side of the central follower plane than the dummy round.

9. The detachable magazine of claim 2, wherein the transition region has an upper end and a lower end, wherein the at least one left lateral rib includes a rear left lateral rib and a front left lateral rib, wherein the rear left lateral rib extends a lower rear left lateral distance from the left sidewall at the lower end of the transition region and transitions to extend an upper rear left lateral distance from the left sidewall toward the central magazine plane at the upper end of the transition region, the upper rear left lateral distance being greater than the lower rear left lateral distance and the front left lateral rib extends a lower front left lateral distance from the left sidewall toward the central magazine plane at the lower end of the transition region of the magazine body and transitions to extend an upper front left lateral distance toward the central plane at the upper end of the transition region, the upper front left lateral distance being greater than the lower front left lateral distance and wherein the at least one right lateral rib includes a rear right lateral rib and a front right lateral rib such that the rear right lateral rib extends a lower rear right lateral distance from the right sidewall toward the central magazine plane at the lower end of the transition region and transitions to extend an upper rear right lateral distance toward the central plane at the upper end of the transition region, the upper rear right lateral distance being greater than the lower rear right lateral distance and wherein the front right lateral rib extends a lower front right lateral distance from the right sidewall toward the central magazine plane at the lower end of the transition region and transitions to extend an upper front right lateral distance toward the central magazine plane at the upper end of the transition region, the upper front right lateral distance being greater than the lower front right lateral distance.

10. The detachable magazine of claim 9, wherein the follower body includes a follower reference plane, the follower body further including an upper portion extending away from the follower reference plane in a first direction and a lower portion extending in a second direction away from the follower reference plane, the second direction being opposite the first direction, the upper portion having a left side and a right side as well a front and a rear, wherein a left rear rib slot and a left front rib slot are defined in the left side of the upper portion of the follower body and a right rear rib slot and a right front rib slow are defined in the right side, left rear rib slot being configured to receive the left rear lateral rib and the front left rib slot is configured to receive the front left lateral rib, the right rear rib slot being configured to receive the right rear lateral rib and the right front rib slot is configured to receive the right front lateral rib.

11. A detachable magazine for firearms, comprising:

a magazine body having a top portion having a feed region formed therein, a bottom portion, a left sidewall extending from the top portion to the bottom portion, a right sidewall extending from the top portion to the bottom portion, the right sidewall being spaced apart the left sidewall to define a magazine body recess, the left sidewall and the right sidewall being generally parallel to each other, and wherein a central magazine plane is defined between the left sidewall and the right sidewall, the magazine body further including a transition region in communication with the feed region and a quad stack region in communication with the transition region; and a follower assembly having a follower body, the follower body configured to be received at least partially within the magazine body recess, the follower assembly being configured to travel through both the quad stack region and the transition region and into communication with the feed region, wherein the follower body includes a follower reference plane, the follower body further including an upper portion extending away from the follower reference plane in a first direction and a lower portion extending in a second direction away from the follower reference plane, the second direction being opposite the first direction, the upper portion having a left side and a right side as well a front and a rear, wherein the follower assembly further includes a bolt catch mechanism coupled to the top of the follower body, the bolt catch mechanism including a bolt catch and a biasing member, the bolt catch having a front end and a second end, the front end of the bolt catch being rotatingly coupled to the front of the upper portion of the follower body, while the second end is configured to rotate relative to the front end of the bolt catch, the biasing member being configured to exert a biasing force on the second end of the bolt catch urge the second end of the bolt catch away from the follower reference plane.

12. The detachable magazine of claim 11, wherein a central follower plane is defined between the left side and the right side of the upper portion, the follower assembly further including a dummy round link pivotingly coupled to the upper portion of the follower body, the dummy round link being further coupled to a dummy round, the dummy round being oriented parallel to the central follower plane, wherein the dummy round link is configured to allow the dummy round to move between a first position and a second position such that the dummy round is relatively closer to the central follower plane in the first position than in the second position.

13. The detachable magazine of claim 11, wherein in the second position the dummy round is relatively closer to the follower reference plane than in the first position.

14. The detachable magazine of claim 12, further including at least one left lateral rib extending away from left sidewall and toward the central magazine plane and at least one right lateral rib extending away from the right sidewall and toward the central magazine plane.

15. The detachable magazine of claim 14, wherein the transition region has an upper end and a lower end, wherein the at least one left lateral rib extends a lower left lateral distance from the left sidewall toward the central magazine plane at the lower end of the transition region and transitions to extend an upper left lateral distance from the left sidewall toward the central magazine plane at the upper end of the transition region, the upper left lateral distance being greater than the lower left lateral distance, and wherein the at least one right lateral rib extends a lower right lateral distance from the right sidewall toward the central magazine plane at the lower end of the transition region and transitions to extend an upper right lateral distance from the right sidewall toward the central magazine plane at the upper end of the transition region, the upper right lateral distance being greater than the lower right lateral distance.

16. The detachable magazine of claim 15, wherein at least one left rib slot is defined in the left side and at least one rib slot is defined in the right side, the at least one left rib slot being configured to receive the at least one left lateral rib and the at least one right rib slot being configured to receive the at least one right lateral rib.

* * * * *